US012330852B2

(12) United States Patent
Merzeau et al.

(10) Patent No.: US 12,330,852 B2
(45) Date of Patent: Jun. 17, 2025

(54) NESTED BEVERAGE CARTON LAYOUT

(71) Applicant: WestRock Packaging Systems, LLC, Atlanta, GA (US)

(72) Inventors: Julien D. Merzeau, Châteauroux (FR); Dominique Perrin, Saint Maur (FR); Nicolas Teillol, Diors (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 804 days.

(21) Appl. No.: 17/413,888

(22) PCT Filed: Dec. 9, 2019

(86) PCT No.: PCT/US2019/065150
§ 371 (c)(1),
(2) Date: Jun. 14, 2021

(87) PCT Pub. No.: WO2020/123340
PCT Pub. Date: Jun. 18, 2020

(65) Prior Publication Data

US 2022/0055812 A1 Feb. 24, 2022

Related U.S. Application Data

(60) Provisional application No. 62/779,901, filed on Dec. 14, 2018.

(51) Int. Cl.
*B65D 71/36* (2006.01)

(52) U.S. Cl.
CPC ..... *B65D 71/36* (2013.01); *B65D 2301/10* (2013.01); *B65D 2571/00141* (2013.01);
(Continued)

(58) Field of Classification Search
CPC ..... B65D 2571/00185; B65D 71/38; B65D 2571/00716; B65D 2571/00456;
(Continued)

(56) References Cited

U.S. PATENT DOCUMENTS 2,529,725 A 11/1950 Currie
2,762,550 A 9/1956 Goettsch et al.
(Continued)

FOREIGN PATENT DOCUMENTS

WO 2016100455 A1 6/2016
WO 2020197921 A1 10/2020

OTHER PUBLICATIONS

European Office Action dated Oct. 16, 2024, pp. 6.
PCT International Search Report and Written Opinion issued during the prosecution of PCT/US2019/065150.

*Primary Examiner* — Christopher R Demeree
(74) *Attorney, Agent, or Firm* — Brian J. Goldberg; Rohini K. Garg; Tsugihiko Suzuki

(57) ABSTRACT

A packaging carton for packaging one or more articles and to blanks (100, 200, 1000) for forming the packaging carton. The carton and blanks comprise a plurality of panels for forming the carton including a top panel (108), a bottom panel (112), a first side panel (110), and a pair of partial side panels (106, 114). Each of the bottom panel, the first side panel, and the first partial side panel has a first and a second end flap hingedly connected thereto in opposition from each other, and the partial side panels adhere together to form a complete second side panel to enclose an interior volume for containing articles. The end flaps of the blank (100, 200, 1000) define an edge shape which is configured to be nested with the edge of an identical blank.

20 Claims, 10 Drawing Sheets

(52) U.S. Cl.
CPC ..... *B65D 2571/0066* (2013.01); *B65D 2571/00728* (2013.01)

(58) Field of Classification Search
CPC ..... B65D 2571/00388; B65D 2571/00759; B65D 5/48014; B65D 2203/08; B65D 71/36; B65D 2301/10; B65D 2571/00141; B65D 2571/0066; B65D 2571/00728; B65D 2571/00444; B65B 41/02; B65B 21/24; B65B 21/242; B65B 27/04; B65B 11/004; B31B 2241/001
USPC ..... 229/103.2, 112, 113, 115, 164, 934; 206/427, 173, 434

See application file for complete search history.

(56) References Cited

U.S. PATENT DOCUMENTS

| | | | | |
|---|---|---|---|---|
| 2,816,699 | A | 12/1957 | Nute et al. | |
| 3,578,238 | A | 5/1971 | Schillinger et al. | |
| 3,651,982 | A * | 3/1972 | Slevin ..... | B65D 71/0022 206/187 |
| 3,731,872 | A | 5/1973 | McCormick | |
| 4,339,068 | A * | 7/1982 | Brauner ..... | B65D 5/667 229/148 |
| 4,763,832 | A * | 8/1988 | Forbes, Jr. ..... | B65D 5/667 229/152 |
| 5,381,948 | A * | 1/1995 | Coalier ..... | B65D 5/46088 229/164 |
| 6,223,979 | B1 * | 5/2001 | Correll ..... | B65D 5/6655 229/149 |
| 2012/0067755 | A1 | 3/2012 | Spivey, Sr. | |
| 2015/0174847 | A1 | 6/2015 | Thum | |

* cited by examiner

NESTED BEVERAGE CARTON LAYOUT

BACKGROUND OF THE INVENTION

1. Field of the Invention

The present disclosure relates to blanks such as used in forming containers and cartons, and more particularly to the nesting techniques such as used in arranging multiple blanks on a stock material. The present disclosure also relates to the cartons formed from assembly of blanks.

2. Description of Related Art

A variety of forms and techniques are known in the art for forming packaging blanks from sheets of a stock material such as paperboard. A variety of containers and cartons can be produced from such blanks. During the manufacture of packaging blanks from stock materials, portions of the stock material which are not ultimately part of the finished blanks constitute scrap material. Conventional techniques in manufacturing packaging blanks have been considered satisfactory. However, cartons are still relatively expensive to manufacture. Thus, a need continues to exist for further reduction in the stock material required for their manufacture. This disclosure provides a solution for this need.

SUMMARY OF THE INVENTION

A blank for forming a carton includes first, second, and third portions arranged along a longitudinal axis of the blank. The first portion has a blank maximum width, the second portion has a blank minimum width, and the third portion is disposed between the first and second portions and has a primary width. The maximum, minimum and primary widths each extend perpendicularly to the longitudinal axis, and the primary width is a dimension measured along a center axis of the blank. The center axis is perpendicular to the longitudinal axis and passes through a midpoint along a length of the blank. The primary width is equal to or less than a half of the sum of the blank maximum width and the blank minimum width.

The blank can include a pair of opposed free side edges each extending generally transversely with respect to the center axis. At least part of at least one of the free side edges can be symmetrical about a point of symmetry. The blank can include a point of symmetry located at an intersection of the center axis and the at least part of the at least one of the free side edges. The at least part of the at least one of the free side edges can be linear or straight. The longitudinal axis can pass through a midpoint along the primary width, and the blank can be symmetrical about the longitudinal axis.

The blank can also include a plurality of panels hingedly connected together to define an interior of a carton when the blank is erected into said carton. The plurality of panels can include a top panel, a bottom panel, and a pair of opposed bottom end flaps hingedly connected to opposed side edges of the bottom panel. The first portion can include comprises a bottom panel and the bottom end flaps. The second portion can include the top panel. The plurality of panels can further include a first side panel disposed between the top and bottom panels and a pair of opposed side end flaps hingedly connected to the first side panel. The third portion can include the first side panel and the side end flaps.

The plurality of panels hingedly connected together can define an interior of the carton when the blank is erected into the carton. The plurality of panels can include a top panel, a bottom panel, a first side panel disposed between the top and bottom panels and a pair of opposed side end flaps hingedly connected to the first side panel. The third portion can include the first side panel and the side end flaps. One of the side end flaps can provide the at least part of the at least one of the free side edges on which the point of symmetry can be located.

The blank can be nestable with another blank of the same size and configuration such that the at least part of the at least one of the free side edges of the blank and that of said another blank are formed by a single die cut blade.

The blank can include a fourth portion and a fifth portion arranged along the longitudinal axis and located at opposed longitudinal ends of the blank. The fourth portion can have a fourth portion maximum width and the fifth portion can have a fifth portion minimum width. The fourth portion maximum width and fifth portion maximum width can each extend perpendicularly to the longitudinal axis. The fourth portion maximum width can be greater than the primary width. The fifth portion maximum width can be less than the primary width.

The blank can include a plurality of panels. The plurality of panels can include a first partial side panel hingedly connected to the bottom panel, a second partial side panel hingedly connected to the top panel, a pair of opposed first partial side end flaps hingedly connected to the first partial side panel, and a pair of opposed second partial side end flaps hingedly connected to the second partial side panel. The first partial side panel and the first partial side end flaps together can provide a fourth portion of the blank. The second partial side panel and the second partial side end flaps together can provide a fifth portion of the blank. The fourth portion can have a fourth portion maximum width. The fifth portion can have a fifth portion minimum width. The fourth portion maximum width and fifth portion maximum width can each extending perpendicularly to the longitudinal axis. The fourth portion maximum width can be greater than the primary width. The fifth portion maximum width can be less than the primary width.

The blank can include a top panel that has a top panel length which can be measured along the longitudinal axis. The blank can also include a bottom panel that has a bottom panel length which can be measured along the longitudinal axis. The top panel length can generally be equal to the bottom panel length.

The first partial side panel of the blank can have a first partial side panel length which can be measured along the longitudinal axis. The second partial side panel can have a second partial side panel length which can be measured along the longitudinal axis. The first partial side panel length can be generally equal to the second partial side panel length. The first side panel can have a first side panel length which can be measured along the longitudinal axis. The first side panel length can be less than a sum of the first partial side panel length and the second partial side panel length. The first partial side panel and second partial side panel together can provide a single second side panel of when the blank is erected into the carton.

The blank can also have a third portion which has a third portion maximum width. The third portion maximum width can extend perpendicularly to the longitudinal axis. The third portion maximum width can be greater than the primary width.

A blank for forming a packaging container includes a bottom panel, a first partial side panel hingedly connected to a first side of the bottom panel, a first side panel hingedly connected to the second side of the bottom panel, a top panel hingedly connected to the first side panel, and a second partial side panel hingedly connected to the top panel. Each of the bottom panel, the first side panel, and the first partial side panel has a first and a second end flap hingedly connected thereto in opposition from each other. The first end flaps define a first blank edge and the second end flaps define a second blank edge. The first blank edge is configured such that it can be nested with the first blank edge of an identical blank, and the second blank edge is configured such that it can be nested with the second blank edge of an identical blank.

Each of a side end flap hingedly connected to the first partial side panel, a bottom end flap hingedly connected to the bottom panel, and a side end flap hingedly connected to the first side panel can be arranged such that their edges follow a convex arcuate shape. Each of the edge of the second partial side panel, the edge of the top panel, and a side end flap hingedly connected to the first side panel can be arranged such that their edges follow a concave arcuate shape. The concave arcuate shape can approximate a convex arcuate shape created by an arrangement of each of a side end flap hingedly connected to the first partial side panel, the bottom end flap hingedly connected to the bottom panel, and a side end flap hingedly connected to the first side panel such that two identical blanks can nest closely together.

Each bottom end flap can be configured such that it can abut along a single edge with the top panel of an identical blank when the two identical blanks are nested together on a suitable substrate. The top panel can be configured such that it can abut along a single edge with a bottom end flap of an identical blank when the two identical blanks are nested together on a suitable substrate. The edge of the bottom end flap and the edge of the top panel can be parallel. Each end flap hingedly connected to the first side panel can be configured such that it can abut along a single edge with the end flap hingedly connected to the first side panel of an identical blank when the two identical blanks are nested together on a suitable substrate. Each end flap hingedly connected to the first partial side panel can be configured such that it can abut along a single edge with the end flap hingedly connected to the second partial side panel of an identical blank when the two identical blanks are nested together on a suitable substrate. Each end flap hingedly connected to the second partial side panel can be configured such that it can abut along a single edge with the end flap hingedly connected to the first partial side panel of an identical blank when the two identical blanks are nested together on a suitable substrate. The edges of the each of the end flaps can be oblique edges. A portion of each side end flap and a portion of the edge of the second partial side panel can be varnish-free for securing by glue when assembled into a carton.

The edge of the top panel can protrude perpendicularly to a longitudinal blank axis which can increase the width of a portion of the top panel. The protrusion of the top panel can have curved corners on either side of a flat edge. The curved corners can have a radius that corresponds to the radius of a container such that the top panel can cover the container. The edge of the top panel can be flat such that the top panel is a constant width over its entire length.

A packaging carton includes a plurality of panels which define an interior volume for containing articles. The packaging carton includes a bottom panel, a first partial side panel hingedly connected to a first side of the bottom panel, a first side panel hingedly connected to the second side of the bottom panel, a top panel hingedly connected to the first side panel, and a second partial side panel hingedly connected to the top panel. Each of the bottom panel, the first side panel, and the first partial side panel has a first and a second end flap hingedly connected thereto in opposition from each other. The first partial side panel and the second partial side panel are adhered together to form a complete second side panel which encloses the interior volume with the top panel, the bottom panel, the first side panel and the second side panel. The end flaps and bottom flaps fold together and are adhered to form an at least partially enclosed end of the interior volume. The first end flaps define a first edge and the second end flaps define a second edge, and the first edge is configured such that it can be nested with the edge formed by the first end flaps of an identical blank. The second edge is configured such that it can be nested with the edge formed by the second end flaps of an identical blank.

The packaging container can include a second partial side panel with a first and a second end flap hingedly connected thereto in opposition from each other. The packaging container can include end flaps hingedly connected to each of the first and second partial side panels which can be adhered to form a shape which can be identical to the end flaps hingedly connected to the first side panel. These and other features of the blanks and containers of the subject disclosure will become more readily apparent to those skilled in the art from the following detailed description of the preferred embodiments taken in conjunction with the drawings.

DETAILED DESCRIPTION OF THE DRAWINGS

So that those skilled in the art to which the subject disclosure appertains will readily understand how to make and use the devices of the subject disclosure without undue experimentations, preferred embodiments thereof will be described in detail herein below with reference to certain figures, wherein.

DETAILED DESCRIPTION OF THE PREFERRED EMBODIMENTS

Figure 1:
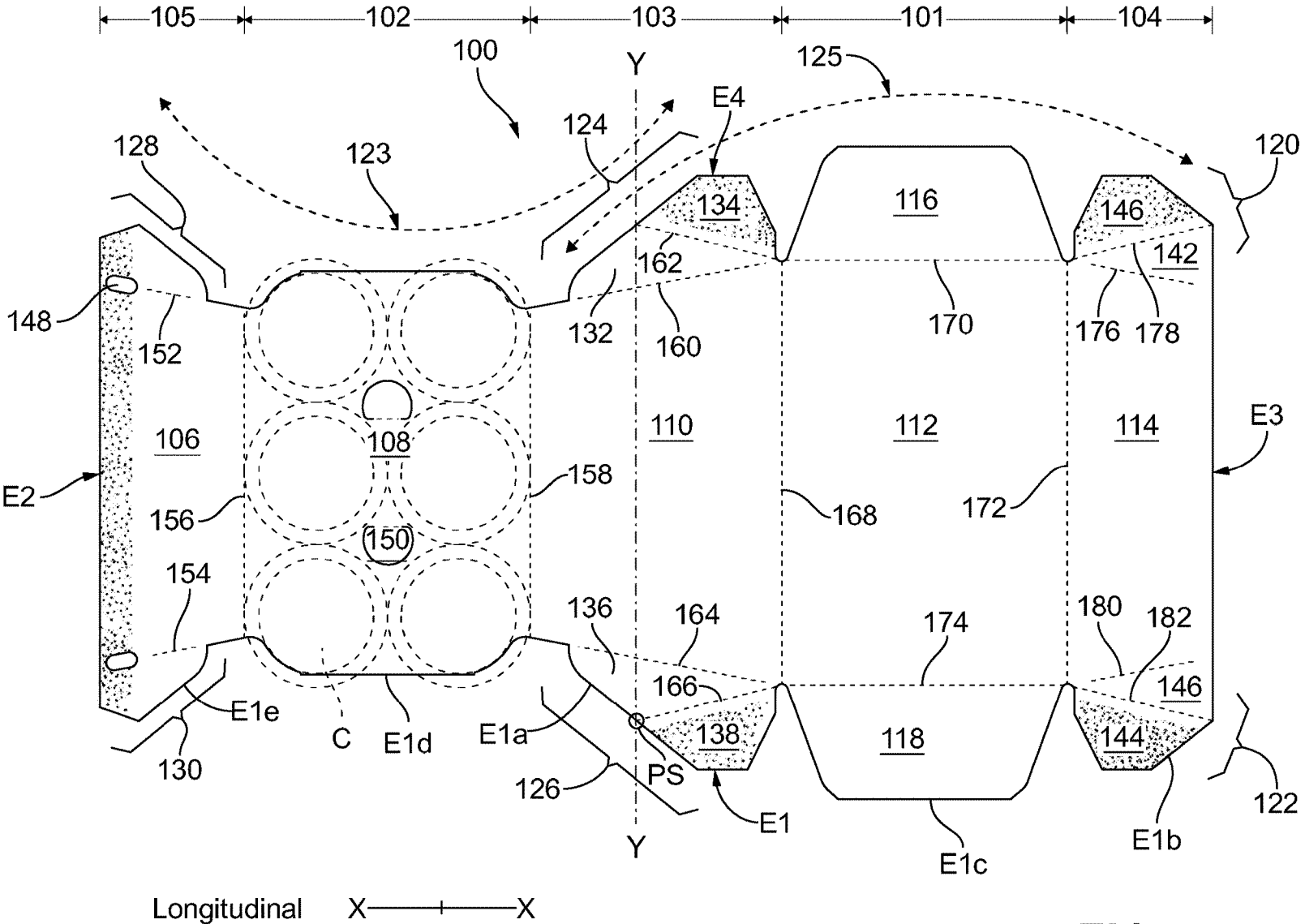
FIG. 1 is a plan view of an exemplary embodiment of a blank constructed in accordance with the present disclosure.

Reference will now be made to the drawings wherein like reference numerals identify similar structural features or aspects of the subject disclosure. For purposes of explanation and illustration, and not limitation, a view of an exemplary embodiment of a blank in accordance with the disclosure is show in FIG. 1 and is designated generally by reference character 100. Other embodiments of blanks in accordance with the disclosure, or aspects thereof, are provided in FIG. 2-10, as will be described. The blanks described herein can be used in the creation of packaging cartons, e.g., for use in the commercial sale of beverage containers.

Packaging blanks can be formed from a suitable substrate, e.g., sheets of paperboard, by cutting the stock material to form an array of packing blanks, using a blanking process to separate individual blanks in the stock material from one another. As used herein, the term "suitable substrate" includes all manner of foldable sheet material such as paperboard, corrugated board, cardboard, plastic, combinations thereof, and the like. Graphic material can be printed on one or both sides of the substrate. Ultimately, the individual blanks can be formed into containers or packages with graphical print, for example.

Blank 100 is for a package which can be used for carrying a plurality of beverage containers, e.g., bottles or cans. Blank 100 includes a plurality of panels which are hingedly connected together and define the interior of the carton when folded and adhered together, the panels being a top panel 108, bottom panel 112, first side panel 110, first partial side panel 114 and a second partial side panel 106. The bottom panel 112 is hingedly connected on a first side across transverse fold line 172 to the first partial side panel 114, and hingedly connected on a second side across transverse fold line 168 to the first side panel 110. The first side panel 110 is disposed between the bottom panel 112 and the top panel 108, to which the first side panel is hingedly connected across transverse fold line 158. The top panel 108 is also hingedly connected across transverse fold line 156 to the second partial side panel 106. The hinged connections between each panel and flap disclosed herein are created by fold lines which are creased or scored to allow the carton to be folded together in an efficient and repeatable fashion.

The first portion 101 of blank 100 is comprised of the bottom panel 112 together with a pair of opposed bottom end flaps 116, 118 which are hingedly connected to opposed side edges of the bottom panel. The hinged connected between the bottom end flaps 116, 118, and the bottom panel 112 is created by upper and lower longitudinal fold lines 170, 174. The second portion 102 of blank 100 is comprised of the top panel 102. The third portion 103 of blank 100 is comprised of the first side panel 110 and a pair of opposed side end flaps 124, 126 hingedly connected to the first side panel 110 across oblique fold lines 160, 164. The fourth portion 104 of blank 100 is comprised of the first partial side panel 114 and a pair of opposed first partial side end flaps 120, 122 hingedly connected to the first partial side panel 114 across oblique fold lines 176 and 180. The fifth portion 105 of blank 100 is comprised of the second partial side panel 106 and a pair of opposed second partial side end flaps 128, 130 hingedly connected to the second partial side panel 106 across oblique fold lines 152, 154. Blank 100 includes portions 101, 102, 103, 104, 105 arranged along a longitudinal axis (X-X) of the blank.

Each of the pair of opposed first partial side end flaps 120, 122 is divided into distal portions 140, 144 and proximal portions 142, 146 by fold lines 178, 182 which are oblique to the longitudinal axis (X-X). Likewise, each of the side end flaps 124, 126 is divided into distal portions 134, 138 and proximal portions 132, 136 by fold lines 162, 166 which are oblique to the longitudinal axis (X-X). The division of the partial side end flaps 120, 122 and side end flaps 124, 126 aids in the retention and securing of beverage containers C upon assembly of the blank 100 into a carton.

Also shown on the blank 100 are areas of the blank substrate which are provided varnish free. The varnish-free patches are depicted by spotted areas on the second partial side panel 106, and the distal areas 134, 138, 140, 144 of the side flaps 120, 122, 124, 126. The varnish-free portions are prepared in this manner so that upon assembling the blank 100 into a carton, glue, adhesive or other bonding means can be applied to these areas and a secure bond will be achieved. The blank 100 also has a pair of void punchouts 148 in the second partial side panel and finger receiving apertures 150 in the top panel.

Blank 100 includes a pair of opposed free side edges E1, E4 each extending generally in the transverse direction with respect to the center axis (Y-Y), e.g., the free side edges transverse the center axis (Y-Y). The opposed free side edge E1 is broken into subcomponents E1*a*, E1*b*, E1*c*, E1*d*, and E1*e*. E1*a* refers generally to the edge formed by the shape of a side end flap 126, 126. E1*b* refers generally to the edge formed by the shape of a first partial side end flap 120, 122. E1*c* refers generally to the edge formed by the shape of a bottom flap 116, 118. E1*d* refers generally to the edge formed by the shape of the top panel 108. E1*e* refers generally to the edge formed by the shape of a second partial side end flap 128, 130. One of the free side edges E1 is generally defined by one half of each pair of end flaps 118, 122, 126, 130, and the other free side edge E4 is generally defined by the other half of the pair of end flaps 116, 120, 124, 128. At least part (i.e., E1*a*, E1*b*, E1*c*, E1*d*, E1*e*) of at least one of the free side edges E1 is symmetrical about a point of symmetry PS. The point of symmetry PS is located at an intersection of the center axis (Y-Y) and the at least part E1*a* of the at least one of the free side edges E1. The point of symmetry PS may be located along an edge E1*a* formed by the shape of a side end flap 124, 126. At least part E1*a* of the at least one of the free side edges E1 is linear or straight. Blank 100 refers to the edge of the first partial side panel which is not hingedly connected to another panel as E3, and the edge of the second partial side panel which is not hingedly connected to another panel as E2. Edges E2 and E3 run parallel to the center axis (Y-Y).

The partial side end flaps 120, 122 connected to the first partial side panel 114, the bottom end flaps 116, 118, and the side end flaps 124, 126 connected to the first side panel 110 are arranged such that their edges follow a convex arcuate shape 125. The side end flaps 124, 126 connected to the first side panel, the edge of the top panel 108, and the partial side end flaps 128, 130 are arranged such that their edges follow a concave arcuate shape 123. The concave arcuate shape approximates the convex arcuate shape such that two identical blanks can nest closely together on a substrate.

Figure 3:
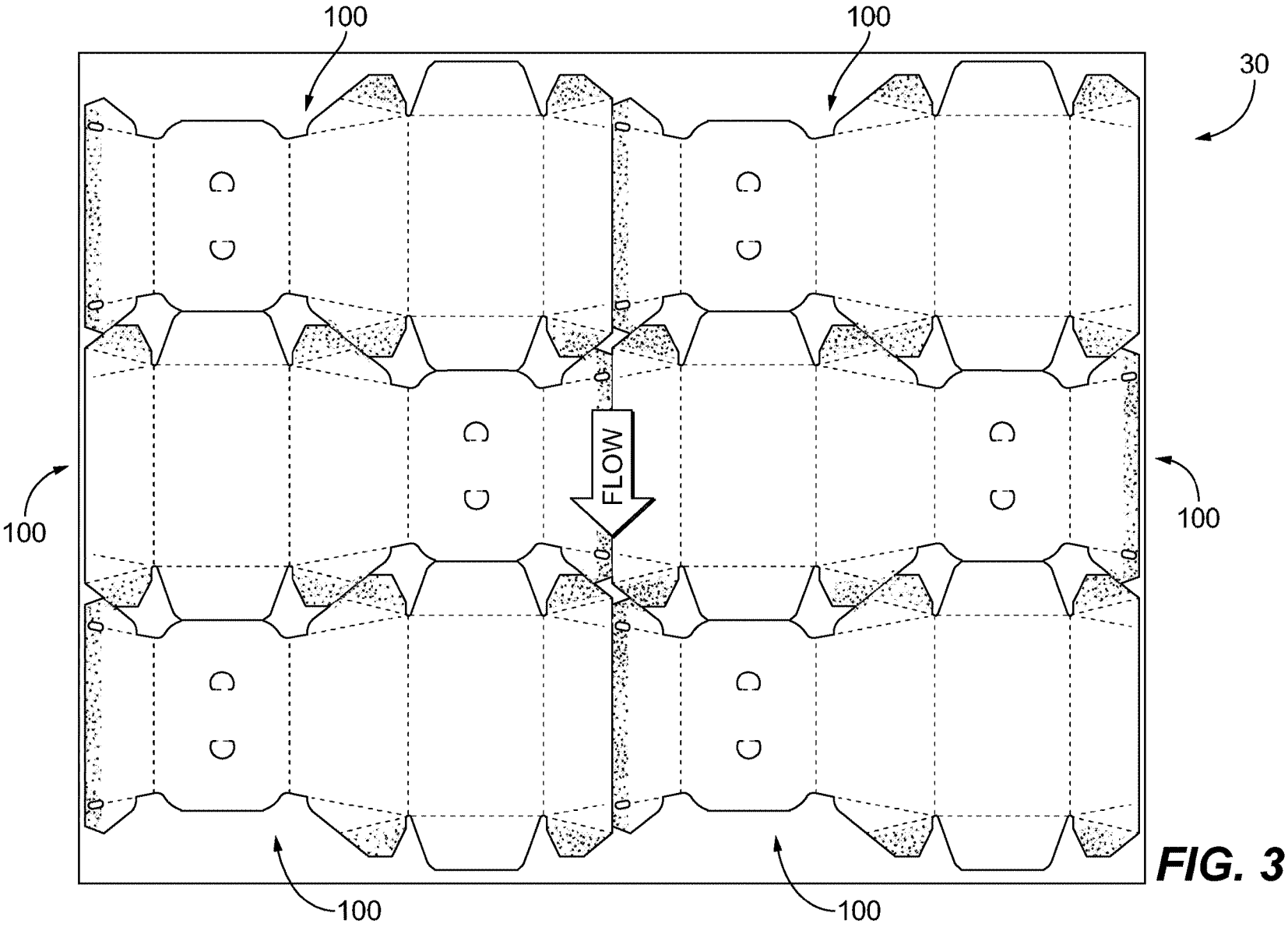
FIG. 3 is a plan view of the blank of FIG. 1, showing the blanking grid.
Figure 4:
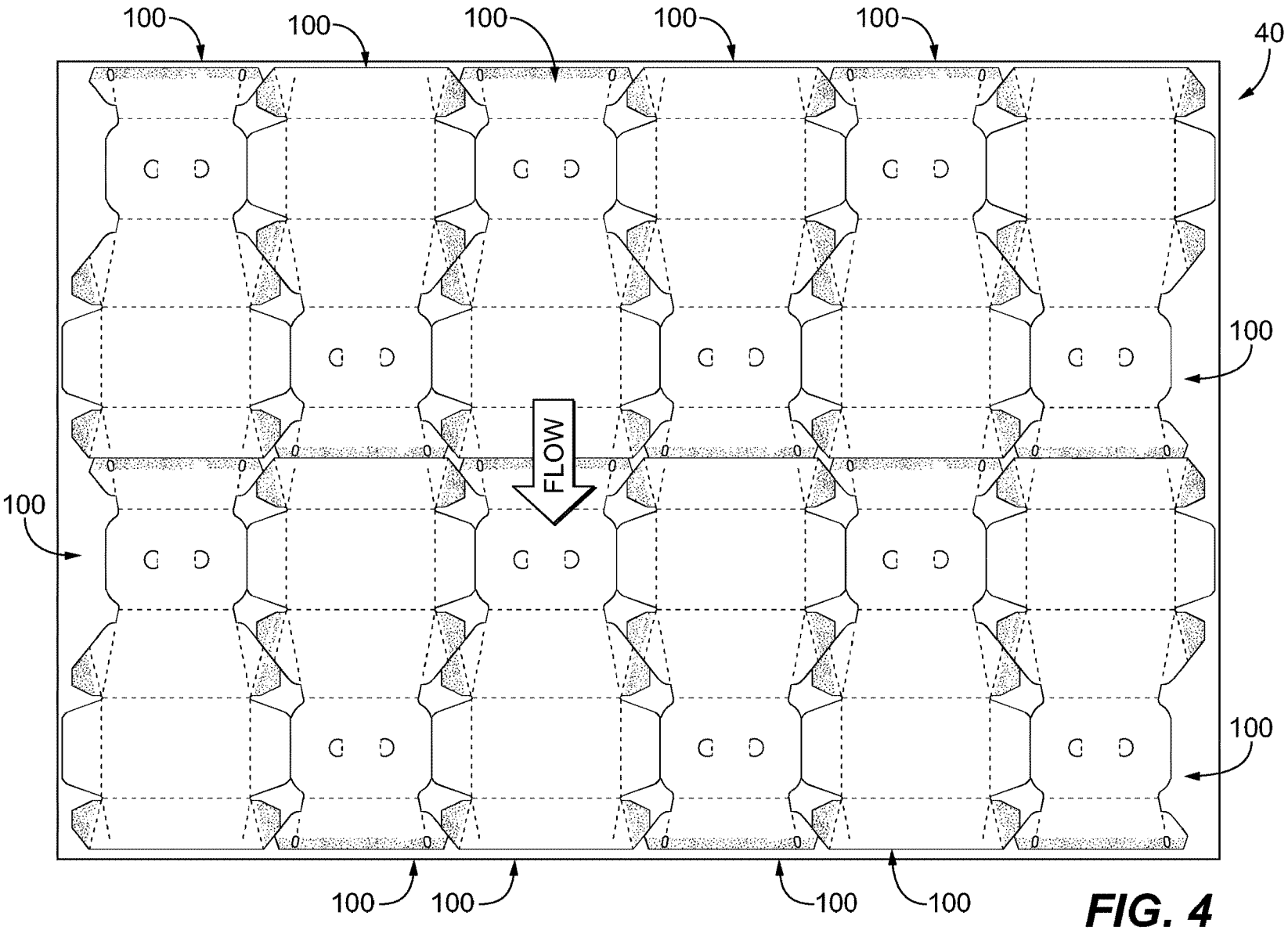
FIG. 4 is a second plan view of the blank of FIG. 1, showing a second grid.

The blank 100 is nestable with another blank of the same size and configuration as shown in FIGS. 3 and 4 such that the at least part (E1*a*, E1*b*, E1*c*, E1*d*, E1*e*) of the at least one of the free side edges E1 of the blank 100 and that of another blank are formed by a single die cut blade. The free side edge E1 is configured such that it nests with the same free side edge E1 of another blank 100 of the same size and configuration. The edge E1 of a first blank 100 is configured so that when nested together with an identical second blank 100, the bottom end flap 118 of the first blank 100 abuts or nearly abuts along the edge part E1*c* with the edge part E1*d* of the top panel 108 of the second blank 100. The edge E1 of a first blank 100 is also configured so that when nested together with an identical second blank 100, the end flap 122 connected to the first partial side panel 114 of the first blank 100 abuts or nearly abuts along the edge part E1*b* with the edge part E1*e* of the end flap 130 connected to the second partial side panel 106 of the second blank 100. The edge E1 of a first blank 100 is also configured so that when nested together with an identical second blank 100, the side end flap 126 of the first blank 100 abuts along the edge part E1*a* with the edge part E1*a* of the side end flap 126 of the second blank 100. The edge part E1*c* of the bottom end flap 118 and the edge part E1*d* of the top panel 108 are parallel in order to aid in the nesting described above and are parallel to the longitudinal axis (X-X). The edges of the end flaps 122, 130 and the side end flap 126 are oblique for the same reason. The edge part E1*d* of the top panel 108 of blank 100 protrudes in a direction perpendicular to the longitudinal axis (X-X) so as to increase the width of the top panel 108. The edge part E1*d* is primarily flat, parallel to the longitudinal axis (X-X), however the edge part E1*d* has rounded corners which have a radius that corresponds to that of the top of a beverage container C in order to fully cover the top of the container with the top panel 108.

Figure 2:
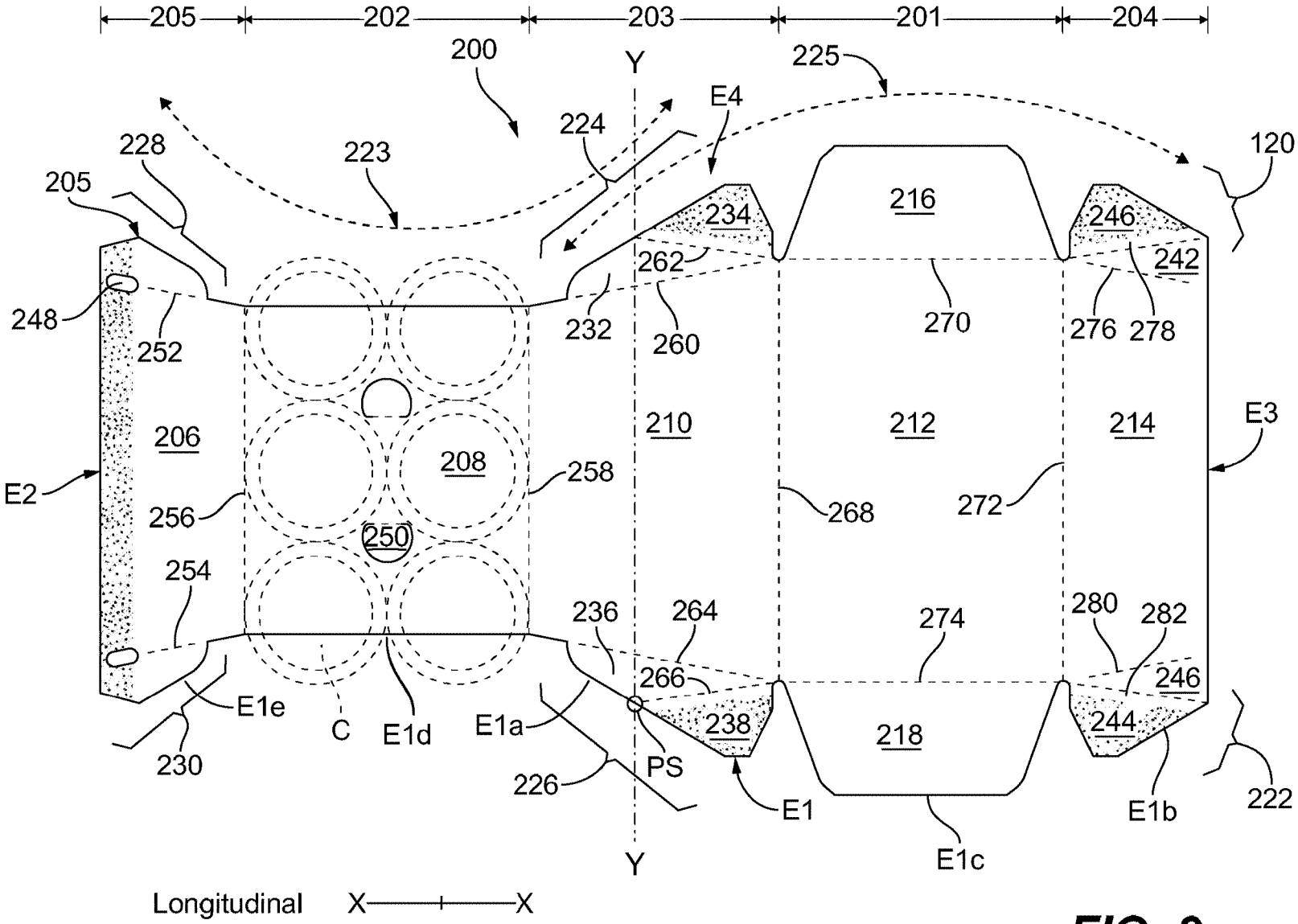
FIG. 2 is a plan view of an another exemplary embodiment of a blank constructed in accordance with the present disclosure.

Now referring to FIG. 2, a blank 200 is displayed, which is an alternative embodiment of the blank 100. The features of the blank 100 as described herein may be read as also pertaining to the blank 200, except as follows: the edge E1*d* of the top panel 208 of blank 200 is flat, or parallel to a longitudinal axis (X-X) along the blank so as to maintain a constant width of the top panel 208.

Figure 7:
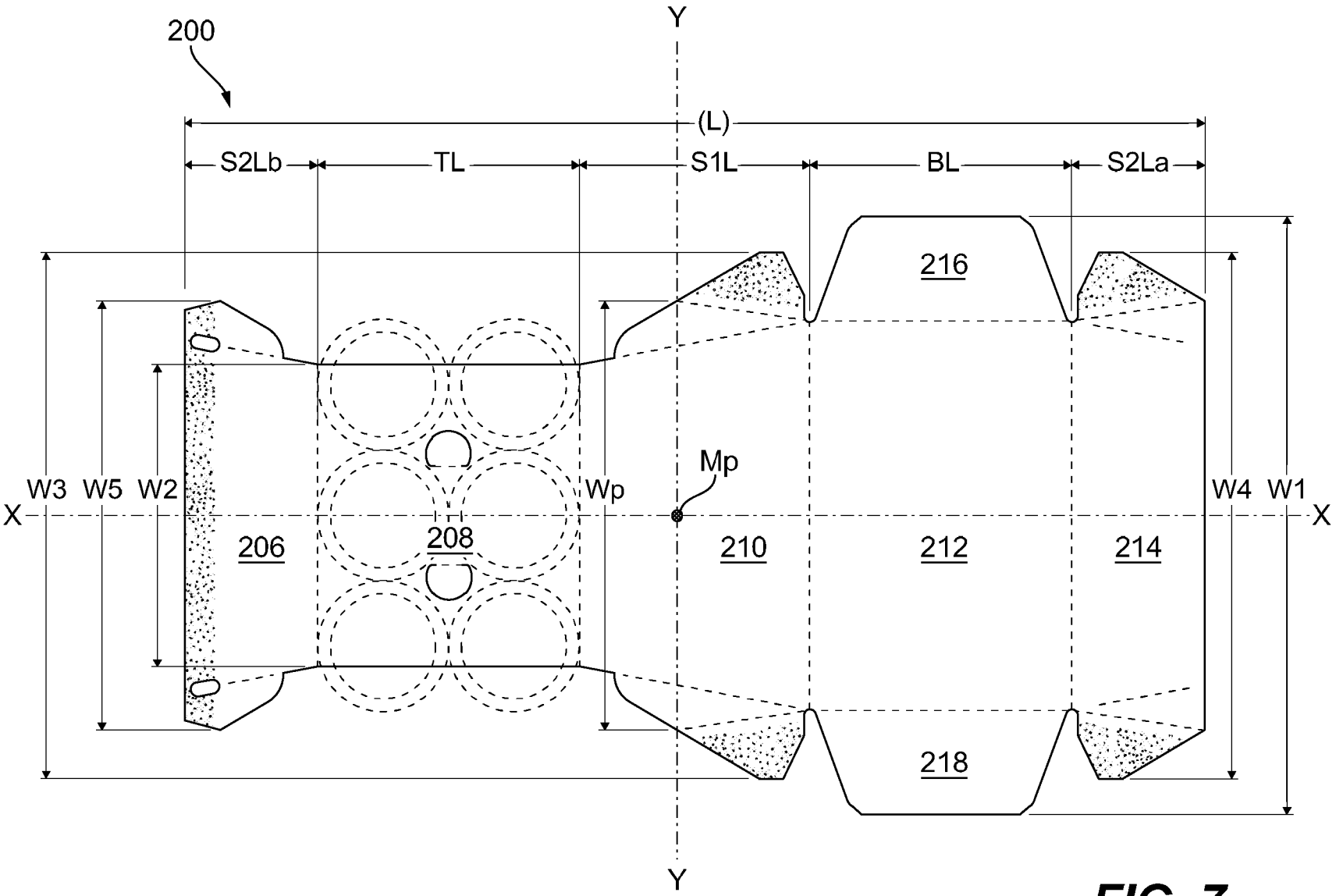
FIG. 7 is a plan view of the blank of FIG. 2, showing additional reference characters.

Now referring to FIG. 7, further reference characters of the blanks 100, 200 are described. The blank layout of FIG. 7 is identical to blank 200 of FIG. 2, however each dimension and feature described by FIG. 7 pertains equally to the blank 100 of FIG. 1. The first portion 201 has a blank maximum width W1, the second portion 202 has a blank minimum width W2, the third portion 203 is disposed between the first and second portions and has a width W3, the fourth portion 204 has a maximum width W4, and the fifth portion has a maximum width W5. The primary width Wp is a dimension measured along a center axis (Y-Y) of the blank. The primary width Wp is equal to or less than a half of the sum of the blank maximum width W1 and the blank minimum width W2. The primary width Wp is less than the third portion maximum width W3. Each of the maximum, minimum and primary widths W1, W2, W3, W4, W5, Wp each extend perpendicularly to the longitudinal axis (X-X). The center axis (Y-Y) is perpendicular to the longitudinal axis (X-X) and passes through a midpoint Mp along a length L of the blank 200. The blank 200 is symmetrical about the longitudinal axis (X-X). The top panel 208 has a top panel length TL, the bottom panel 212 has a bottom panel length BL, first partial side panel 214 has a first partial side panel length S2La, the second partial side panel 206 has a second partial side panel length S2Lb, and the first side panel 210 has a first side panel length S1L. Each of the aforementioned lengths L, TL, BL, S1L, S2La, S2Lb is measured along the longitudinal axis (X-X).

Figure 5:
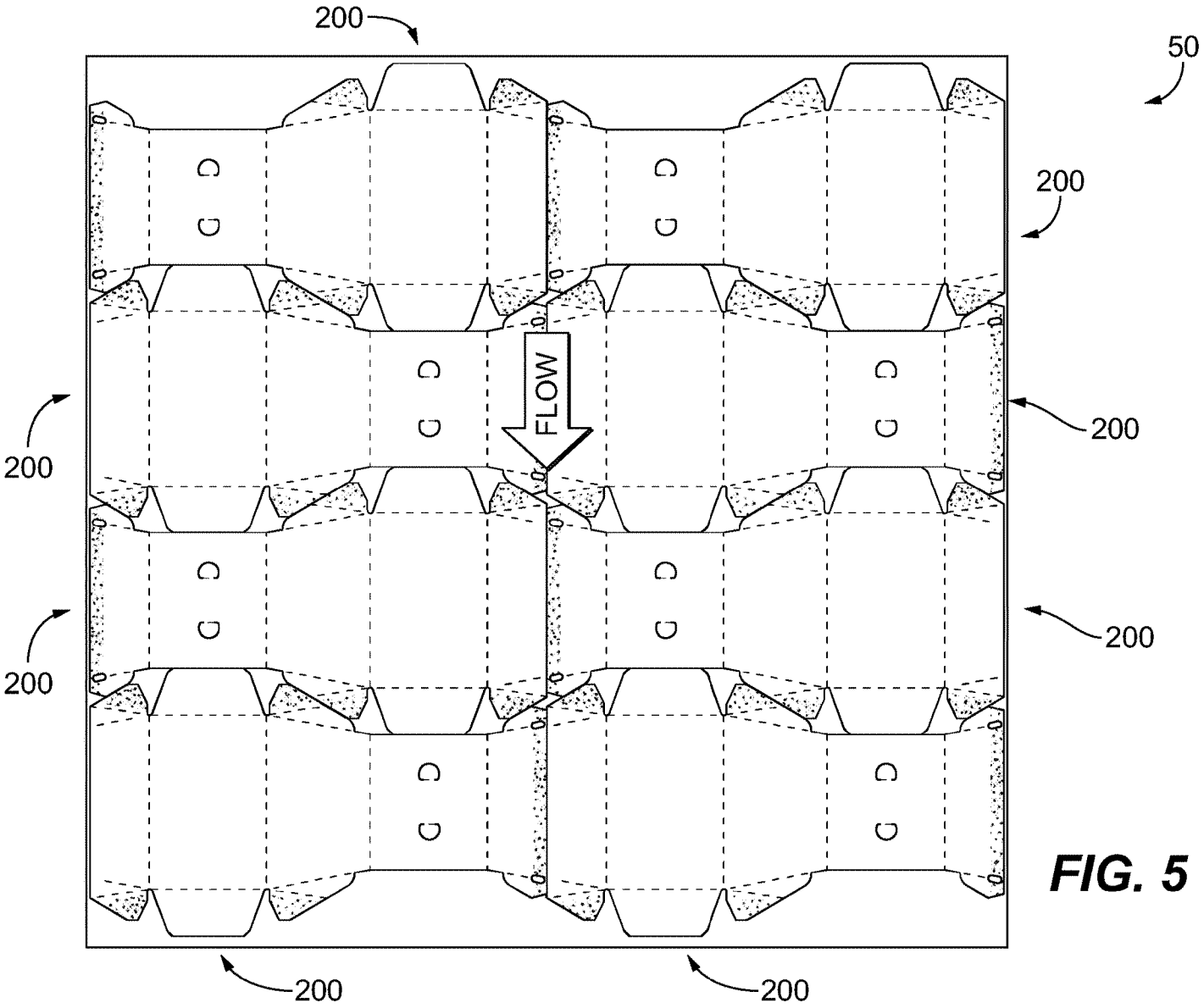
FIG. 5 is a plan view of the blank of FIG. 2, showing the blanking grid.
Figure 6:
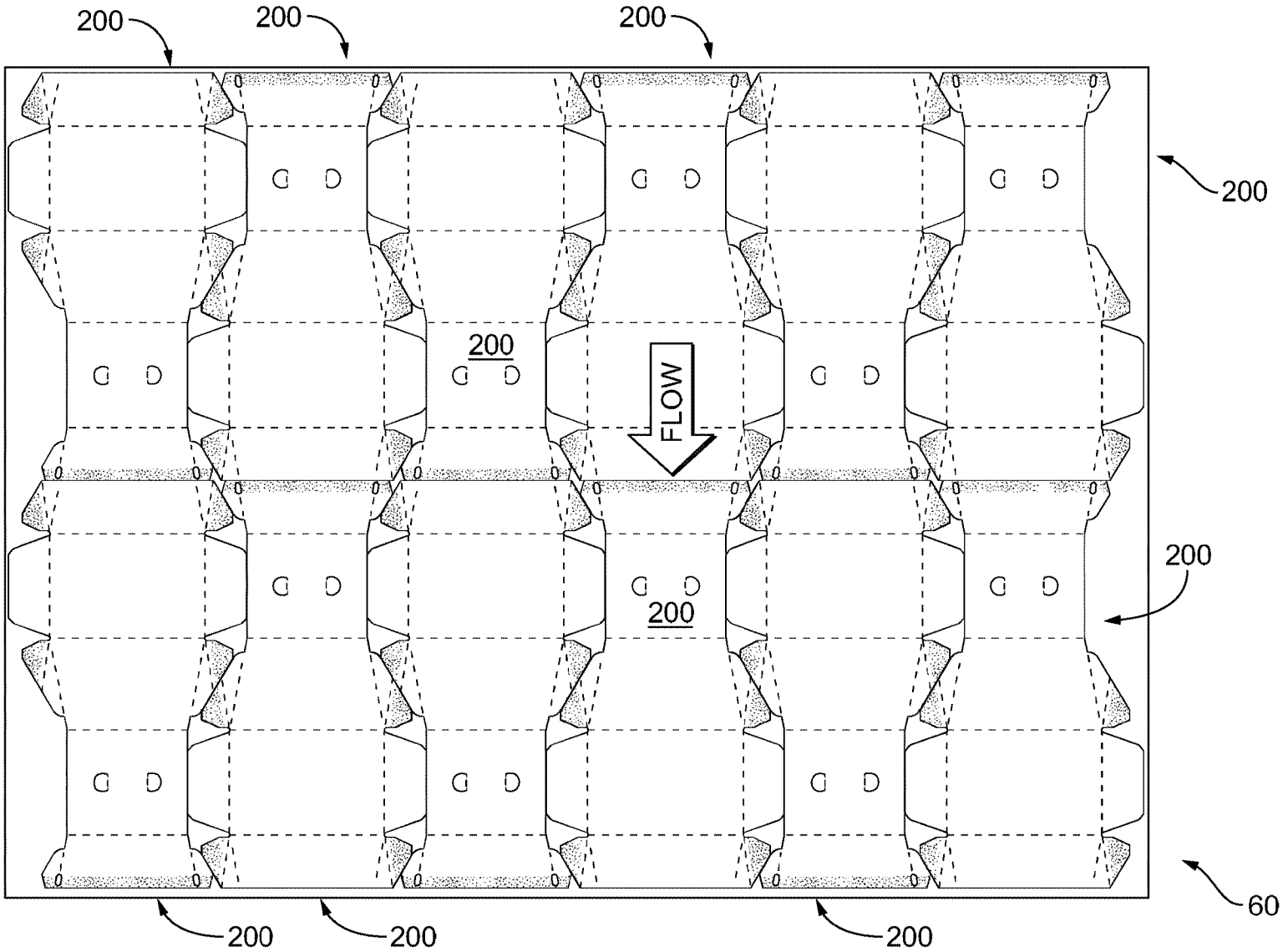
FIG. 6 is a second plan view of the blank of FIG. 2, showing a second grid.

The blank 100 may be arranged into a nesting pattern as displayed in FIG. 3. FIG. 3 demonstrates a layout for a Size 6 die press. An alternative nesting pattern for blank 100 is displayed in FIG. 4, which is the layout for a Size 7 die press. FIG. 5 and FIG. 6 each respectively display a nesting pattern for a blank 200, with FIG. 5 pertaining to a Size 6 die press and FIG. 6 pertaining to a Size 7 die press. The nesting pattern in each of FIGS. 3-6 can allow for optimizing the blanking process by reducing the wasted substrate by providing for close nesting. The blanking patterns disclosed herein allow for more blanks per unit of area of substrate than other layouts, while preserving the look and functionality of the finished carton. Additionally, the having the substrate flowed through a blanking machine in the same direction as the grain of the particular substrate allows for better control of the blanking process by an operator.

Figure 8:
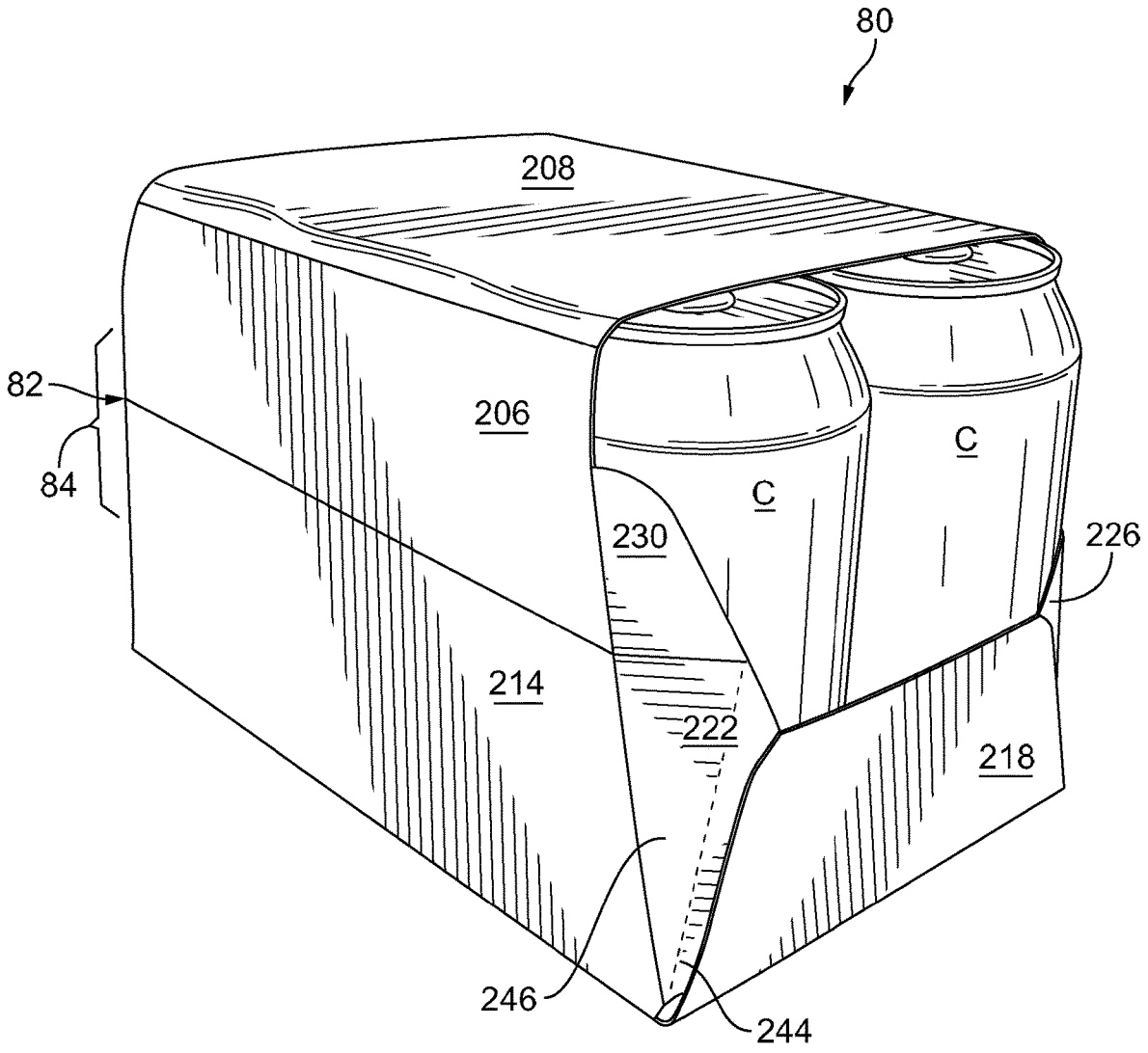
FIG. 8 is a perspective view of the beverage carton formed from the blank of FIG. 2 showing the carton loaded with containers.
Figure 9:
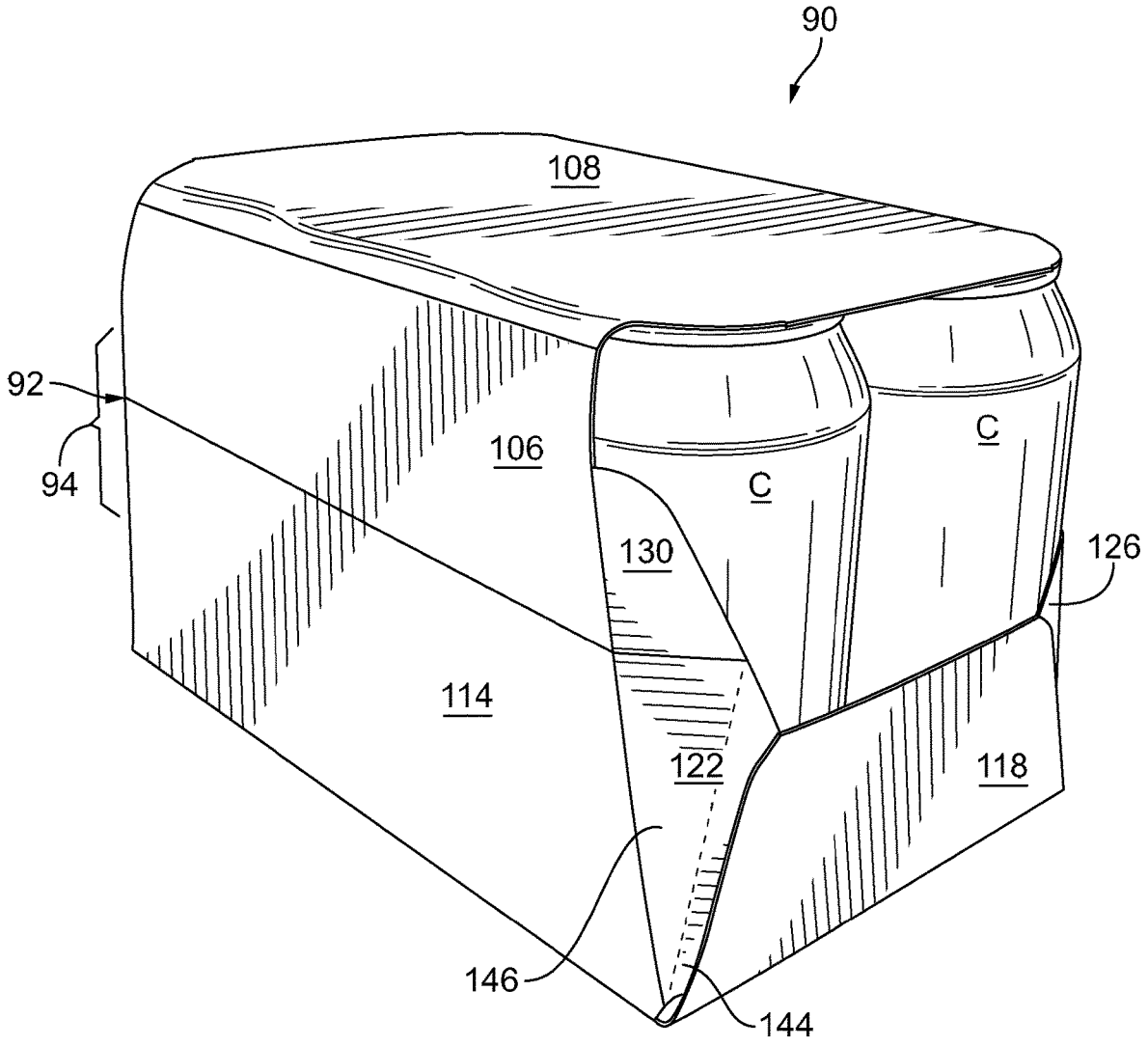
FIG. 9 is a perspective view of the beverage carton formed from the blank of FIG. 1 showing the carton loaded with containers.

Now referring to FIG. 8, an exemplary carton 80 based upon blank 200 of FIG. 2 is described. FIG. 9 demonstrates an exemplary carton 90 based upon the blank 100 of FIG. 1. Each of carton 80 and carton 90 displays the mid-glued flap line 82, 92 employed attach the first partial side panel 114, 214 to the second partial side panel 106, 206 in order to form the assembled second side panel 84, 94. Cartons 80 and 90 as depicted in FIGS. 8 and 9 respectively also demonstrate how the bottom end flap 118, 218, the side end flap 126, 226 and the combination of the two partial side end flaps 122, 130, 222, 230 fold together to partially enclose the carton. Carton 90 as depicted in FIG. 9 demonstrates how, when assembled and loaded with beverage containers C, the top panel 108 covers the beverage containers C. In an embodiment, the combination of the partial end flaps 122, 130, 222, 230 as assembled and adhered together, creates an identical shape to the side end flap 126, 226.

Figure 10:
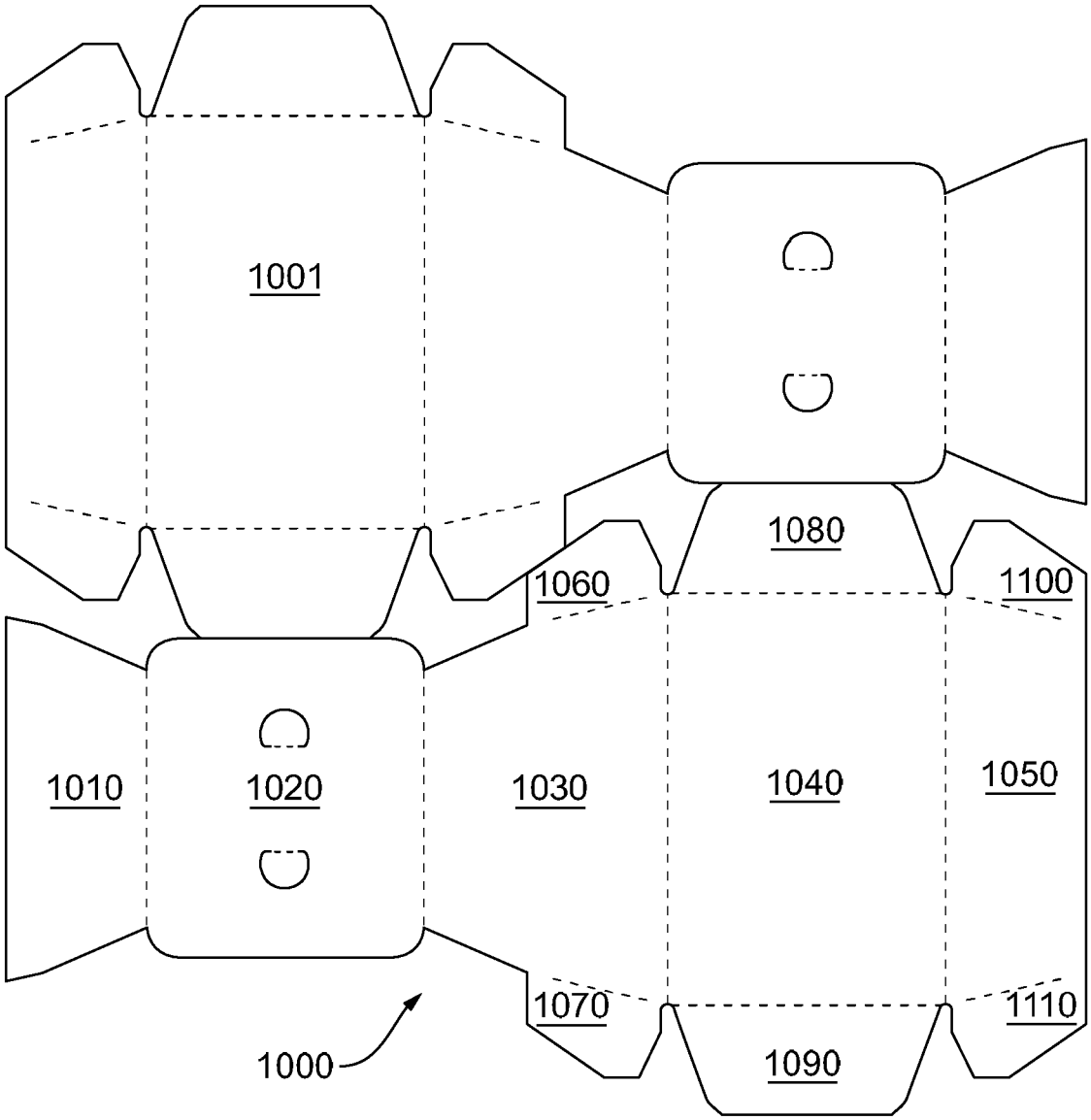
FIG. 10 is a plan view of another exemplary embodiment of a blank constructed in accordance with the present disclosure.

Now referring to FIG. 10, a blank 1000 is displayed, which is an alternative embodiment of the blanks 100, 200 of FIGS. 1 and 2. The blank 1000 is comprised of a bottom panel 1040, a top panel 1020, a first side panel 1030, a first partial side panel 1050, and a second partial side panel 1010. A pair of opposed bottom end flaps 1080, 1090 are hingedly connected to opposed side edges of the bottom panel 1040. A pair of opposed side end flaps 1060, 1070 are hingedly connected to the first side panel 1030, and a pair of opposed side end flaps 1100, 1110 are hingedly connected to the first partial side panel 1050. The features of the blank 100 as described herein may be read as also pertaining to the blank 1000, except as follows: the top panel 1020 of blank 1000 approximates a rectangle with rounded corners, with edge E1*d* being parallel to a longitudinal axis (X-X) along the blank so as to maintain a constant width of the top panel 1020. Additionally, the second side end flap 1010 of blank 1000 has no end flaps. Also shown in FIG. 10 is an identical blank 1001 which is positioned so as to nest with the blank 1000.

The present disclosure, as described above and shown in the drawings, provides for blanks which can be configured into nesting patterns that allow for highly efficient use of the substrate material while also assembling into a carton which maintains the carrying capacity, durability and strength characteristics typical of such a carton in the field. While the blanks and cartons of the subject disclosure have been shown and described with reference to preferred embodiments, those skilled in the art will readily appreciate that changes and/or modifications may be made thereto without departing from the scope of the subject disclosure.

What is claimed is:

1. A blank for forming a carton, the blank comprising:

first, second, and third portions arranged along a longitudinal axis of the blank, the first portion having a blank maximum width, the second portion having a blank minimum width, the third portion being disposed between the first and second portions and having a primary width, the blank maximum width, the blank minimum width, and the primary width each extending perpendicularly to the longitudinal axis, the primary width being a dimension measured along a center axis of the blank, the center axis being perpendicular to the longitudinal axis and passing through a midpoint along a length of the blank, wherein the primary width is equal to or less than a half of a sum of the blank maximum width and the blank minimum width;

a plurality of panels hingedly connected together to define an interior of the carton when the blank is erected into the carton, the plurality of panels including a top panel, a bottom panel and a pair of opposed bottom end flaps hingedly connected to opposed side edges of the bottom panel, wherein the first portion comprises the bottom panel and the bottom end flaps and wherein the second portion comprise the top panel.

2. The blank of claim 1 further comprising a pair of opposed free side edges each extending generally transversely with respect to the center axis, at least part of at least one of the free side edges being symmetrical about a point of symmetry.

3. The blank of claim 2 wherein the blank is nestable with another blank of the same size and configuration such that the at least part of the at least one of the free side edges of the blank and that of said another blank are formed by a single die cut blade.

4. The blank of claim 1 wherein the longitudinal axis passes through a midpoint along the primary width and wherein the blank is symmetrical about the longitudinal axis.

5. The blank of claim 1 further comprising a fourth portion and a fifth portion arranged along the longitudinal axis and located at opposed longitudinal ends of the blank, the fourth portion having a fourth portion maximum width, the fifth portion having a fifth portion maximum width, the fourth portion maximum width and fifth portion maximum width each extending perpendicularly to the longitudinal axis, wherein the fourth portion maximum width is greater than the primary width and wherein the fifth portion maximum width is less than the primary width.

6. The blank of claim 1 wherein the third portion has a third portion maximum width, the third portion maximum width extending perpendicularly to the longitudinal axis, and wherein the third portion maximum width is greater than the primary width.

7. A blank for forming a carton, the blank comprising:

first, second, and third portions arranged along a longitudinal axis of the blank, the first portion having a blank maximum width, the second portion having a blank minimum width, the third portion being disposed between the first and second portions and having a primary width, the blank maximum width, the blank minimum width, and the primary width each extending perpendicularly to the longitudinal axis, the primary width being a dimension measured along a center axis of the blank, the center axis being perpendicular to the longitudinal axis and passing through a midpoint along a length of the blank, wherein the primary width is equal to or less than a half of a sum of the blank maximum width and the blank minimum width;

a pair of opposed free side edges each extending generally transversely with respect to the center axis, at least part of at least one of the free side edges (E1) being symmetrical about a point of symmetry (PS), wherein the point of symmetry is located at an intersection of the center axis and the at least part of the at least one of the free side edges of the blank.

8. The blank of claim 7 further comprising a plurality of panels hingedly connected together to define an interior of the carton when the blank is erected into the carton, the plurality of panels including a top panel, a bottom panel and a pair of opposed bottom end flaps hingedly connected to opposed side edges of the bottom panel, wherein the first portion comprises the bottom panel and the bottom end flaps and wherein the second portion comprises the top panel.

9. The blank of claim 8 wherein the plurality of panels further includes a first side panel disposed between the top and bottom panels and a pair of opposed side end flaps hingedly connected to the first side panel, wherein the third portion comprises the first side panel and the side end flaps.

10. The blank of claim 9 wherein the plurality of panels further includes a first partial side panel hingedly connected to the bottom panel, a second partial side panel hingedly connected to the top panel, a pair of opposed first partial side end flaps hingedly connected to the first partial side panel and a pair of opposed second partial side end flaps hingedly connected to the second partial side panel.

11. The blank of claim 10 wherein the first partial side panel and the first partial side end flaps together provide a fourth portion of the blank and wherein the second partial side panel and the second partial side end flaps together provide a fifth portion of the blank.

12. The blank of claim 11 wherein the fourth portion has a fourth portion maximum width, the fifth portion has a fifth portion maximum width, the fourth portion maximum width and the fifth portion maximum width each extending perpendicularly to the longitudinal axis, and wherein the fourth portion maximum width is greater than the primary width and wherein the fifth portion maximum width is less than the primary width.

13. The blank of claim 10 wherein the first partial side panel has a first partial side panel length measured along the longitudinal axis, the second partial side panel has a second partial side panel length measured along the longitudinal axis and wherein the first partial side panel length is generally equal to the second partial side panel length.

14. The blank of claim 13 wherein the first side panel has a first side panel length measured along the longitudinal axis, the first side panel length is less than a sum of the first partial side panel length and the second partial side panel length.

15. The blank of claim 8 wherein the top panel has a top panel length measured along the longitudinal axis, the bottom panel has a bottom panel length measured along the longitudinal axis and wherein the top panel length is generally equal to the bottom panel length.

16. The blank of claim 7 further comprising a plurality of panels hingedly connected together to define an interior of the carton when the blank is erected into the carton, wherein the plurality of panels includes a top panel, a bottom panel, a first side panel disposed between the top and bottom panels and a pair of opposed side end flaps hingedly connected to the first side panel wherein the third portion comprises the first side panel and the side end flaps wherein one of the side end flaps provides the at least part of the at least one of the free side edges on which the point of symmetry is located.

17. A packaging carton comprising a plurality of panels defining an interior volume for containing articles, including:

a bottom panel;

a first partial side panel hingedly connected to a first side of the bottom panel;

a first side panel hingedly connected to a second side of the bottom panel;

a top panel hingedly connected to the first side panel; and a second partial side panel hingedly connected to the top panel;

wherein each of the bottom panel, the first side panel, and the first partial side panel has a first and a second end flap hingedly connected thereto in opposition from each other;

wherein the first partial side panel and the second partial side panel are adhered together to form a complete second side panel enclosing the interior volume with the top panel, the bottom panel, the first side panel and the second side panel;

wherein a plurality of the end flaps fold together and are adhered to form an at least partially enclosed end of the interior volume;

wherein the first end flaps define a first edge and the second end flaps define a second edge, wherein the first edge is configured to be complementary to a mirror image of itself such that it can be nested and abut with or nearly abut with the first edge formed by the first end flaps of an identical packaging carton when in its blank form, and wherein the second edge is configured to be complementary to a mirror image of itself such that it can be nested and abut with or nearly abut with the second edge formed by the second end flaps of the identical packaging carton when in its blank form.

18. The packaging carton of claim 17, wherein the second partial side panel has a first and a second end flap hingedly connected thereto in opposition from each other.

19. The packaging carton of claim 18 wherein the first and second end flaps hingedly connected to each of the first and second partial side panels are adhered, forming a shape identical to the end flaps hingedly connected to the first side panel.

20. The packaging carton of claim 17, wherein an edge of the top panel either (i) protrudes perpendicular to a longitudinal axis of the blank so as to increase the width of at least a portion of the top panel, or (ii) is flat such that the top panel is a constant width over its entire length.

* * * * *